US005186666A

United States Patent [19]

Stanley

[11] Patent Number: 5,186,666

[45] Date of Patent: Feb. 16, 1993

[54] MARINE MOTOR DRIVE UNIT MOUNTING APPARATUS

[76] Inventor: Thomas R. Stanley, 1645 East 29th Avenue, Vancouver, British Columbia, Canada, V5N 2Y7

[21] Appl. No.: 803,225

[22] Filed: Dec. 6, 1991

[51] Int. Cl.[5] ..... B63H 21/26

[52] U.S. Cl. ..... 440/61; 440/59; 248/642

[58] Field of Search ..... 248/640, 641, 642; 440/53, 58, 59, 61, 63

[56] References Cited

U.S. PATENT DOCUMENTS

| | | | |
|---|---|---|---|
| 2,782,744 | 2/1957 | Staley | 115/41 |
| 3,990,660 | 11/1976 | Pipoz | 440/61 |
| 4,013,249 | 3/1977 | Meyer et al. | 248/4 |
| 4,050,359 | 9/1977 | Mayer | 92/113 |
| 4,354,848 | 10/1982 | Hall et al. | 440/61 |
| 4,367,860 | 1/1983 | Strang | 248/641 |
| 4,384,856 | 5/1983 | Hall et al. | 440/61 |
| 4,673,358 | 6/1987 | Iwai et al. | 440/61 |
| 4,682,961 | 7/1987 | Nakahama | 440/61 |
| 4,813,897 | 3/1989 | Newman et al. | 440/61 |
| 4,836,124 | 6/1989 | Haasl | 114/285 |
| 4,836,811 | 6/1989 | Griffiths et al. | 440/61 |

FOREIGN PATENT DOCUMENTS

| | | | |
|---|---|---|---|
| 0105071 | 4/1984 | European Pat. Off. | 440/63 |

*Primary Examiner*—Sherman Basinger
*Attorney, Agent, or Firm*—Bull, Housser & Tupper

[57] ABSTRACT

An apparatus for mounting a motor drive unit to a boat comprises first and second boat mounting members securable to a boat and lying in a boat plane and includes first and second motor mounting members securable to a motor and lying in a motor plane spaced apart from the boat plane by a distance, the motor plane having an angular orientation relative to the boat plane. A device for setting the motor mounting members in a position displaced from the boat mounting members is connected between the boat mounting members and the motor mounting members. The setting device permits movement of the motor mounting members relative to the boat mounting members, to selectively and independently set the angular orientation, to set the distance between the boat plane and the motor plane, and to set the vertical translation of the motor plane relative to the boat plane.

35 Claims, 12 Drawing Sheets

MARINE MOTOR DRIVE UNIT MOUNTING APPARATUS

BACKGROUND OF THE INVENTION

This invention relates to an apparatus for mounting an outboard motor or a leg portion of a conventional stern-drive motor to a boat.

When racing or cruising in a boat having an outboard motor or stern-drive, it is often desirable to adjust the motor or stern-drive relative to the boat to achieve a desired performance effect. For example, it may be desirable to lower the bow of the boat and raise the stern to increase clearance between the propeller and the ocean bottom below. This can be achieved by tilting the motor into an upward angle of attack thereby lifting the propeller of the motor closer to the surface of the water.

Alternatively, it is sometimes desirable to raise the bow of the boat to cause the boat to plough through the water. This can be achieved by tilting the motor into a downward angle of attack thereby causing the stern of the boat to be driven deeper into the water and raising the bow.

Preferably, the angle of attack of the motor need not be adjusted to raise the motor relative to the bottom but rather, the motor can maintain its angle of attack and yet be lowered or raised relative to the surface of the water. Also, preferably, when racing, the distance between the propeller and the transom can be independently controlled to place the propeller in less or more turbulent water as desired to obtain optimum performance.

Prior art devices such as disclosed in U.S. Pat. No. 4,836,811 to Griffiths et al, U.S. Pat. No. 4,013,249 to Meyer et al, U.S. Pat. No. 4,836,124 to Haasl, U.S. Pat. No. 2,782,744 to Staley, U.S. Pat. No. 4,813,897 to Newman et al and U.S. Pat. No. 3,990,660 to Pipoz each disclose commonly used parallelogram-type motor mounting brackets which permit the angular orientation of the motor relative to the transom of the boat to be maintained constant while the motor is raised or lowered relative to the water. Raising or lowering of the motor, however, causes the motor to also be moved in a horizontal direction and thus the motor cannot be raised or lowered vertically without affecting the horizontal distance between the propeller and the transom.

U.S. Pat. Nos. 4,384,856 and 4,354,848 both to Hall et al, U.S. Pat. No. 4,682,961 to Nakahama and U.S. Pat. No. 4,367,860 to Strang disclose motor brackets which swing the motor through an arc to raise or lower it into the water. The Hall et al patents disclose the use of a trim cylinder to adjust the angle of the motor relative to the bracket during operation. However, it appears that none of these patents discloses an apparatus which permits movement of the motor while maintaining the angular orientation of the motor relative to the transom.

Finally, U.S. Pat. No. 4,673,358 to Iwai et al discloses a motor mounting bracket using a scissor-type of arrangement to rotate a motor.

It appears that each of the above patents have sought to address the problem of mounting a motor to a boat while permitting movement of the motor to adjust performance or to remove the motor from service. However, each of these patents relates to a device or devices for use with an outboard motor only and furthermore, none of the devices appear to permit motor adjustment both horizontally and vertically while maintaining the angular orientation of the motor constant.

SUMMARY OF THE INVENTION

The problem of setting a motor in a position displaced from a boat is addressed by the present invention by providing an apparatus for mounting a motor drive unit to a boat comprising first and second boat mounting members securable to a boat and lying in a boat plane and first and second motor mounting members securable to a motor and lying in a motor plane spaced apart from the boat plane by a distance, the motor plane having an angular orientation relative to the boat plane. A device for setting the motor mounting members in a position displaced from the boat mounting members is connected between the boat mounting members and the motor mounting members. The setting device permits movement of the motor mounting members relative to the boat mounting members, to selectively and independently set the angular orientation, to set the distance between the boat plane and the motor plane, and to set the vertical translation of the motor plane relative to the boat plane.

Preferably, the device for setting the motor mounting members in position is operable to move the first and second motor mounting members relative to the first and second boat mounting members simultaneously or independently along two mutually orthogonal axes while holding the angular orientation constant.

DETAILED DESCRIPTION

Figure 1:
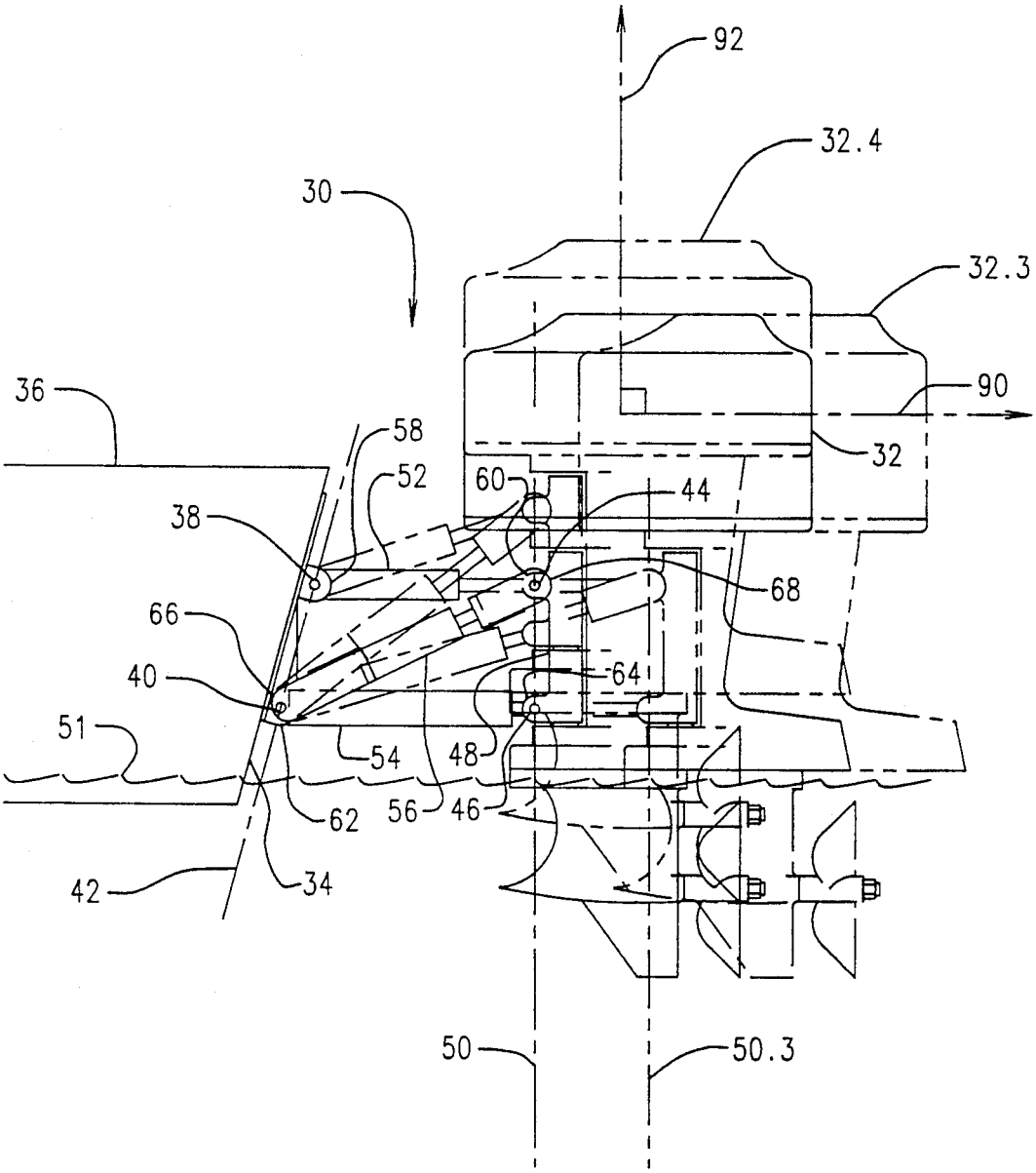
FIG. 1 is a side view of an apparatus according to a first embodiment of the invention; shown mounted on a transom of a boat.

First Embodiment—FIG. 1

Referring to FIG. 1, a motor drive unit mounting apparatus according to the invention is shown generally at 30. The apparatus is shown mounting an outboard motor 32 to a transom 34 of a boat 36.

The apparatus includes first and second boat mounting members 38 and 40 which are rigidly connected in parallel spaced apart relation to the transom 34 of the boat. In this embodiment, the first and second boat mounting members are elongated, cylindrical rods. The first and second boat mounting members lie in a boat plane 42 which extends parallel to the transom 34 of the boat.

The apparatus further includes first and second motor mounting members 44 and 46 which are rigidly connected in parallel spaced apart relation to the outboard motor 32. In this embodiment, the first and second motor mounting members 44 and 46 are also elongated cylindrical rods secured by bolts (not shown) to a conventional steering yoke 48 of the outboard motor. The first and second motor mounting members lie in a motor plane 50. In the embodiment shown, the motor plane is vertical, i.e. perpendicular to the surface 51 of the water whereas the boat plane 42 is at an obtuse angle relative to the surface of the water. The motor plane thus has an angular orientation relative to the boat plane 42 and is spaced apart therefrom.

The apparatus further includes first, second and third hydraulically actuated cylinders 52, 54 and 56 respectively. When viewed from the side, as shown in FIG. 1, the first, second and third cylinders 52, 54 and 56 form a "Z" configuration lying in a plane parallel to the plane of the drawing sheet. Each of the hydraulic cylinders 52, 54 and 56 has respective first and second opposite end portions, the first end portions being disposed adjacent the transom 34 of the boat and the second end portions being disposed adjacent the motor steering yoke 48. The first hydraulic cylinder 52 is connected between the first boat mounting member 38 and the first motor mounting member 44 by first and second hinges 58 and 60 on respective first and second opposite end portions of the first cylinder 52. The first and second hinges permit the first cylinder 52 to rotate about the first boat mounting member 38 and the first motor mounting member 44 in a vertical plane parallel to the plane of the drawing sheet.

The second cylinder has a first hinge 62 and a second hinge 64 and the third cylinder has a first hinge 66 and a second hinge 68. The first and second hinges 62 and 64 on the second cylinder 54 connect the second cylinder between the second boat mounting member 40 and the second motor mounting member 46. The first and second hinges 66 and 68 on the third cylinder 56 connect the third cylinder between the second boat mounting member 40 and the first motor mounting member 44. First hinges 62 and 66 permit the second and third cylinders respectively to rotate about the second boat mounting member 40 while the second hinges 64 and 68 permit the second and third cylinders 54 and 56 to rotate about the second motor mounting member 46 in a vertical plane parallel to the plane of the drawing sheet.

FIG. 2

Figure 2:
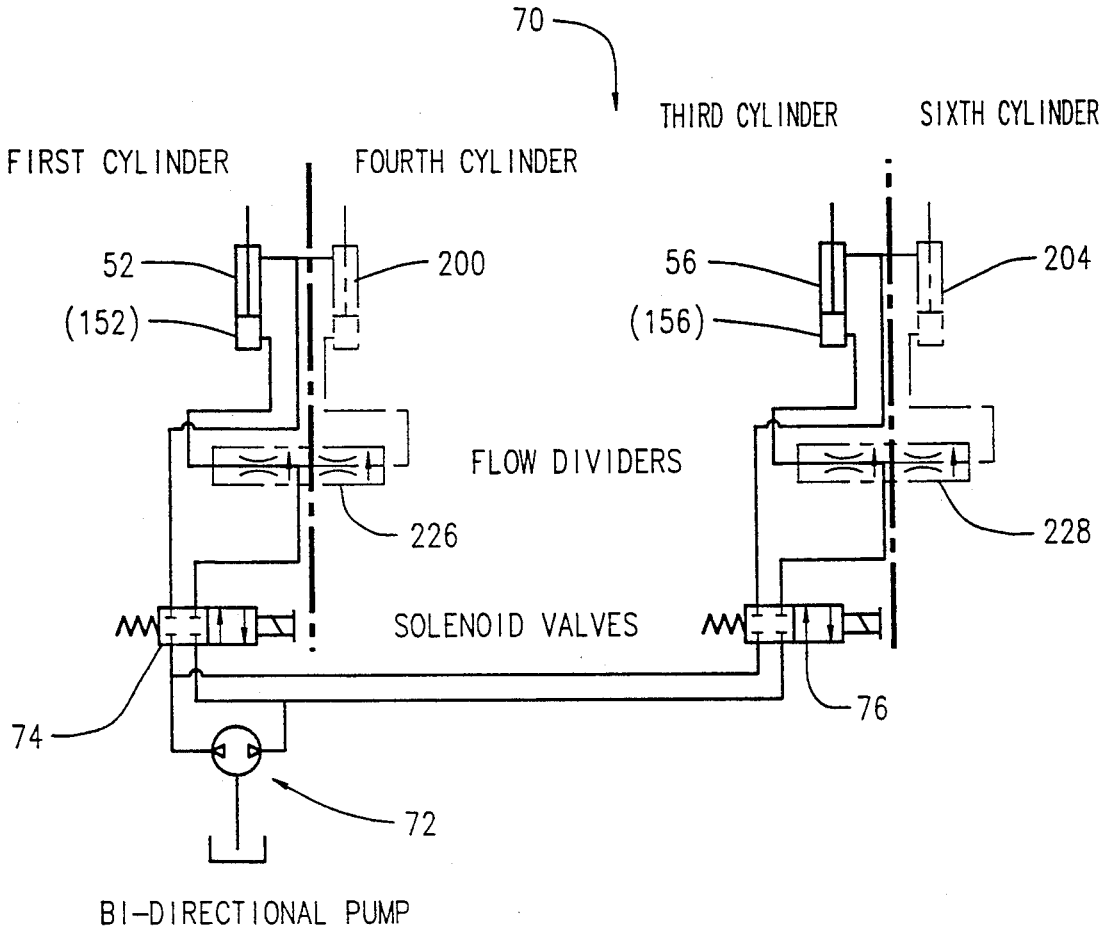
FIG. 2 is a schematic diagram of a first control system according to the invention.

Referring to FIG. 2, a first control system for controlling the first and third cylinders is shown generally at 70. The first control system includes a first bi-directional pump 72 which pumps hydraulic fluid through a first two-position spring biased solenoid control valve 74 for controlling fluid flow to the first cylinder 52 and which pumps hydraulic fluid to a second two-position spring biased solenoid control valve 76 for controlling fluid flow to the third cylinder 56. Actuation of the first solenoid control valve 74 permits extension or retraction of the first cylinder 52, depending upon the operational direction of the bi-directional pump 72. Similarly, actuation of the second solenoid valve 76 permits the third cylinder 56 to be extended or retracted, depending upon the operational direction of the pump 72. The first and second solenoid valves 74 and 76 may be operated independently for independent operation of the first and third cylinders 52 and 56 respectively.

FIG. 3

Figure 3:
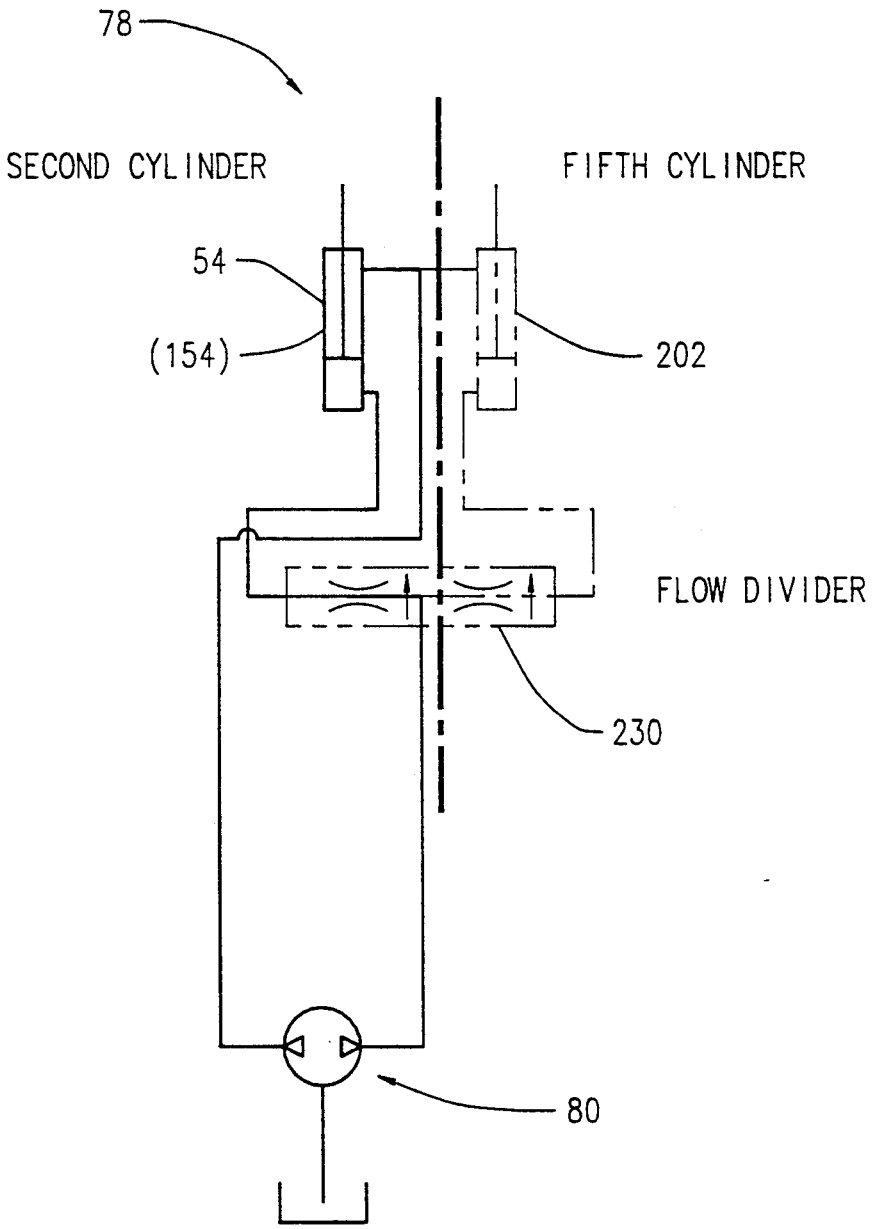
FIG. 3 is a schematic diagram of a second control system according to the invention.

Referring to FIG. 3, a second control system for controlling the extension and retraction of the second cylinder 54 is shown generally at 78. The second control system includes a second bi-directional pump shown generally at 80. The pump pumps hydraulic fluid to second cylinder 54. Second cylinder 54 is extended or retracted, depending upon the operational direction of the bi-directional pump 80. Second cylinder 54 is thus activated independently of the first and third cylinders 52 and 56 of FIG. 2.

OPERATION—FIRST EMBODIMENT

Figure 4:
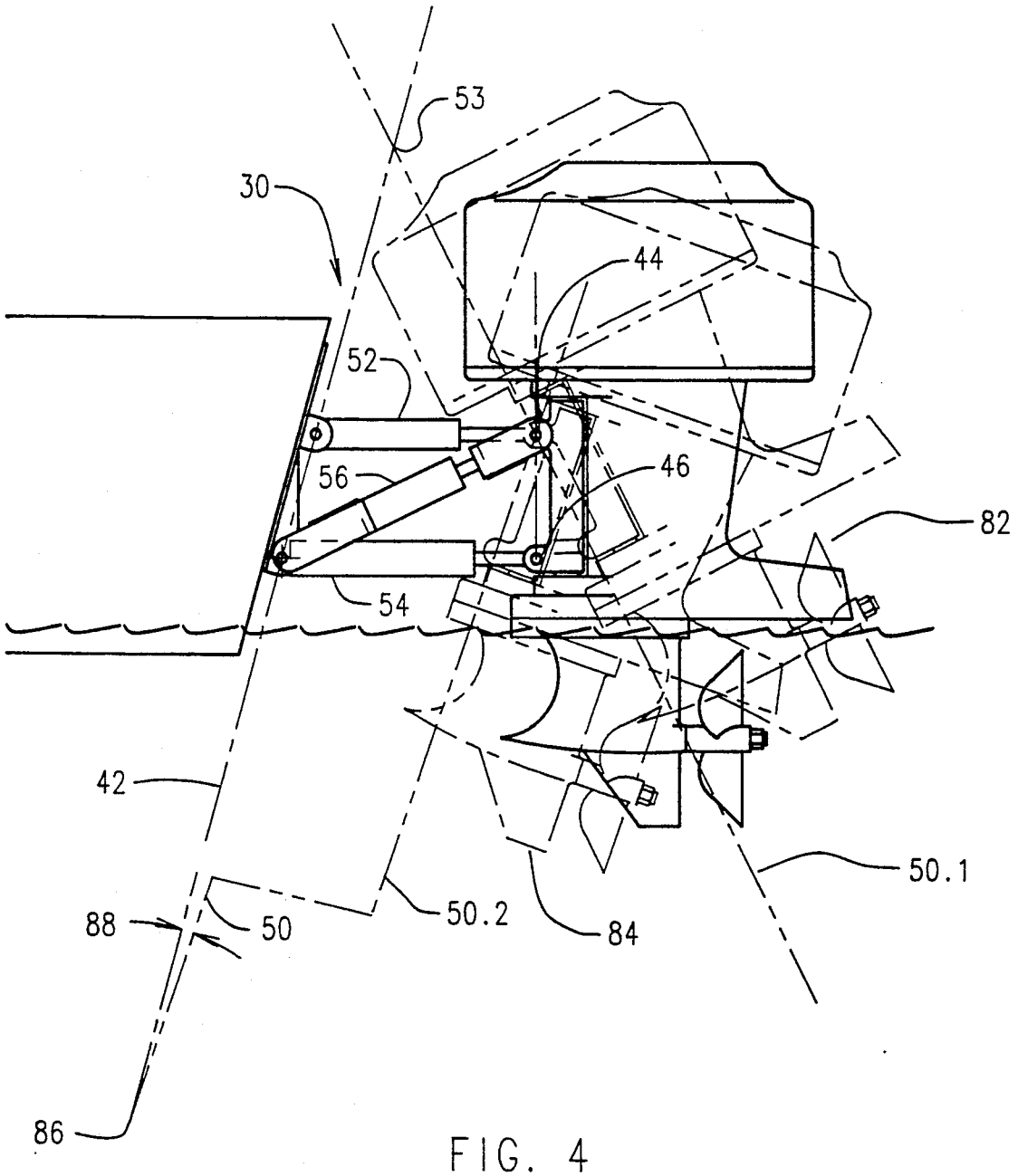
FIG. 4 is a side view of an apparatus according to the invention, illustrating various angular orientations of a motor plane according to the invention.

Referring to FIG. 4, the apparatus 30 is used to set an angle of attack of the motor in the water, to raise and lower the motor relative to the surface of the water (i.e. vertically translate the motor) or to increase or decrease the distance of the motor from the transom. (i.e. horizontally locating the motor). Such adjustment of the motor is commonly referred to as "trimming" the motor.

In the context of the invention herein, setting the angle of attack of the motor is achieved by changing the angular orientation of the motor plane 50 relative to the boat plane 42. This involves activating the bi-directional pump 80 of FIG. 3 to extend or retract the second cylinder 54 while maintaining the first cylinder 52 and the third cylinder 56 at a constant extension. The first and third cylinders are maintained at a constant extension by ensuring that bi-directional pump 72, shown in FIG. 2, and solenoid valves 74 and 76 remain inactivated while bi-directional pump 80 of FIG. 3 is activated.

Referring to FIG. 4, extension of the second cylinder 54 causes the motor plane 50 to rotate about the first motor mounting member 44 in a counter-clockwise direction into the position shown at 50.1. It will be appreciated that when the motor plane is in the position indicated at 50.1, the transom plane 42 and the motor plane intersect at a point 53 above the boat. In this position, the motor has a downward angle of attack as indicated in broken outline at 82.

Conversely, the bi-directional pump so of FIG. 3 may be actuated to retract the second cylinder 54 thereby rotating the motor plane 50 about the first motor mounting member 44 in a clockwise direction, into a position such as shown at 50.2 in FIG. 4. In this position, the motor has an upward angle of attack, as indicated in broken outline at 84. In this position, the motor plane 50.2 and the transom plane 42 intersect at a point 86 below the boat, at which point an angle of orientation 88 measured between the transom plane 42 and the motor plane 50.2 is readily seen.

Although it is preferred to set the angular orientation by keeping the first motor mounting member 44 fixed, and extending or retracting the second cylinder 54, it will be appreciated that the angular orientation may alternatively be adjusted by maintaining the second motor mounting member 46 fixed while extending or retracting the first cylinder 52 and the third cylinder 56.

Moving the motor relative to the transom and/or the surface of the water is explained with reference to FIG. 1. The first and second control systems, shown in FIGS. 2 and 3 respectively, are also used to set the motor mounting members 44 and 46 in a position displaced from the boat mounting members 38 and 40 by moving the motor mounting members along two mutually orthogonal axes, while maintaining the angular orientation of the motor plane 50 constant. In FIG. 1, two mutually orthogonal axes, including a horizontal axis 90 and a vertical axis 92 are indicated.

To move the motor mounting members 44 and 46 and hence the motor 32 along the horizontal axis 90, the first and second control systems 70 and 78, shown in FIGS. 2 and 3 respectively, are actuated to extend the first and second cylinders 52 and 54 equally while extending the third cylinder proportionally. The motor plane 50 is thus moved rearward of the transom into the position shown at 50.3, the motor 32 being shown in broken outline in this extended position at 32.3. Conversely, the motor 32 may be moved back along the horizontal axis 90 from the position shown in broken outline at 32.3 to the position shown in solid outline at 32 by suitable retraction of the first and second cylinders 52 and 54 by equal amounts and retraction of the third cylinder 56 by a proportional amount. Alternatively, the motor 32 may be placed in intermediate positions between the positions indicated at 32 and 32.3.

To move the motor 32 along the vertical axis 92, the third cylinder 56 may be primarily extended while the first and second cylinders 52 and 54 may be proportionally extended thereby raising the motor along the motor plane wherein the motor 32 is raised upward relative to the surface of the water 51 into the position shown in broken outline at 32.4. Conversely, the motor may be lowered from the position shown in broken outline at 32.4 back to the position shown in solid outline at 32 by retraction of the first, second and third cylinders 52, 54 and 56 accordingly. Alternatively, the motor may be placed in intermediate positions between the positions indicated at 32 and 32.4.

It will be appreciated that a further movement of the motor is possible. One desirable movement is achieved by maintaining the first and second cylinders at a constant extension while extending or retracting the third cylinder 56. This has the effect of operating the apparatus as a parallelogram whereby the motor plane 50 follows an arcuate path to raise or lower the motor 32 relative to the water, while maintaining the angular orientation of the motor plane 50 constant.

ALTERNATIVES

SECOND EMBODIMENT—FIG. 5

Figure 5:
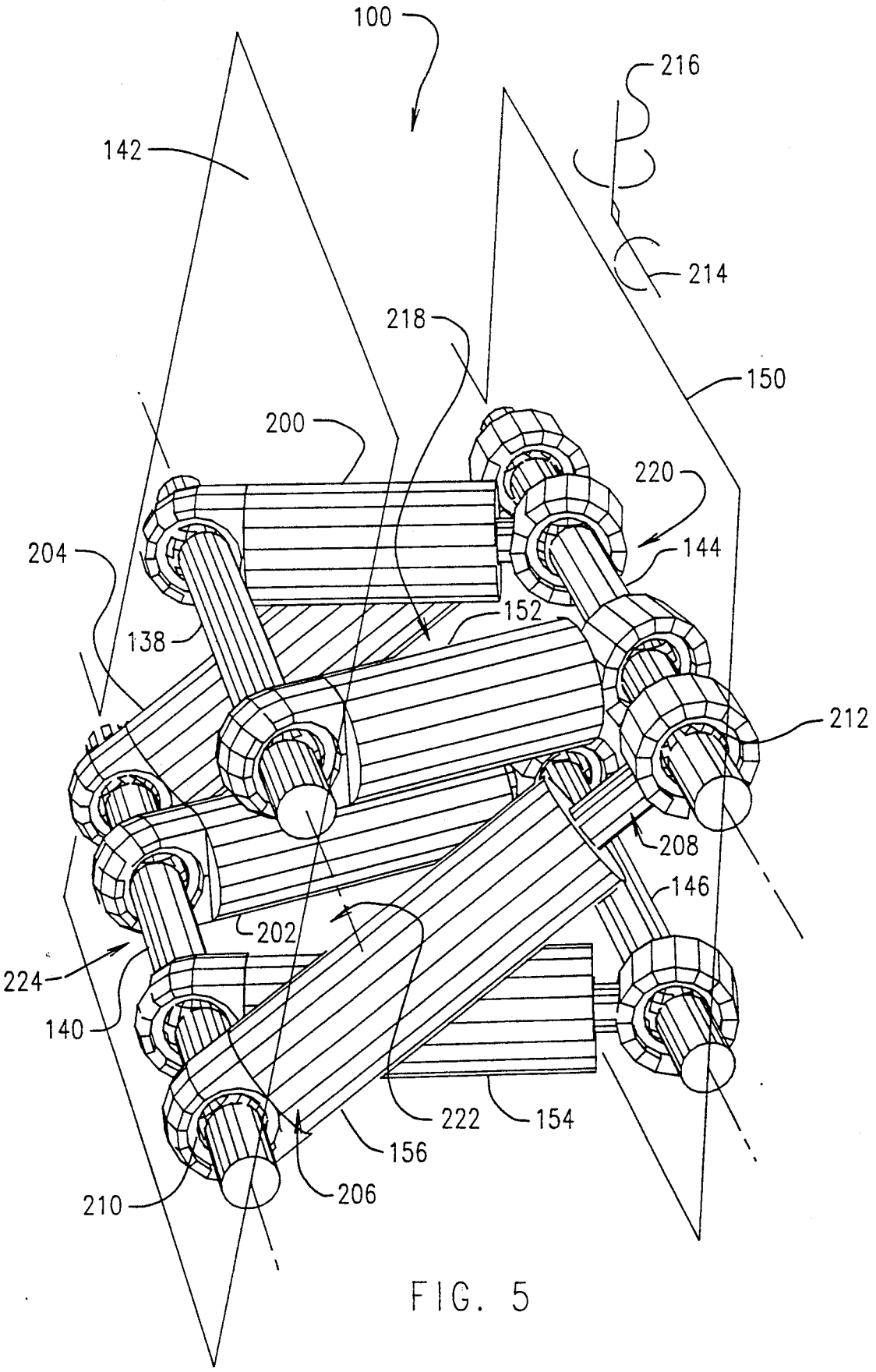
FIG. 5 is a perspective view of an apparatus according to a second embodiment of the invention.

Referring to FIG. 5, an apparatus according to a second embodiment of the invention is shown generally at 100. The apparatus 100 is similar to the apparatus according to the first embodiment in that it includes first and second boat mounting members 138 and 140 rigidly securable to a boat and lying in a boat plane 142. The second embodiment further includes first and second motor mounting members 144 and 146 rigidly securable to a motor and lying in a motor plane 150, the motor plane 150 having an angular orientation relative to the boat plane 142.

The apparatus further includes similar first, second and third hydraulic cylinders 152, 154 and 156 respectively.

The apparatus 100 differs from that of the first embodiment in that it further includes fourth, fifth and sixth hydraulic cylinders 200, 202 and 204 respectively which are similar to the first, second and third cylinders 152, 154 and 156. Each of the cylinders 152, 154, 156, 200, 202 and 204 has respective first and second opposite end portions, only the first and second opposite end portions of cylinder 156 being designated at 206 and 208 respectively, the remaining first and second end portions of each remaining cylinder being similar.

The end portions of each cylinder are terminated in respective spherical rod ends, only the spherical rod ends of the third cylinder 156 being designated generally at 210 and 212 respectively in FIG. 5, the remaining spherical rod ends on the remaining cylinders being similar.

The spherical rod ends are used to connect respective first and second opposite ends of each cylinder 152, 154, 156, 200, 202 and 204 to respective boat and motor mounting members 138, 140, 144 and 146. The spherical rod ends provide a pivotal connection of the respective first and second end portions of respective cylinders, the pivotal connection permitting rotation of any given cylinder about first and second axes 214 and 216. In this embodiment, the first and second axes 214 and 216 are at 90 degrees to each other.

The first and fourth hydraulic cylinders 152 and 200 form a first pair of cylinders 218 and are connected between the first boat mounting member 138 and the first motor mounting member 144 to form a first generally triangular-shaped structure having a first truncated apex shown generally at 220. Similarly, the second and fifth cylinders 154 and 202 form a second pair 222 of fluid actuated cylinders and form a second generally triangular-shaped structure having a second truncated apex portion 224. The first truncated apex portion 220 includes a portion of the first motor mounting member 144 while the second truncated apex portion includes a portion of the second boat mounting member 140. Thus, it will be appreciated that the first generally triangular-shaped structure is directed away, that is, outwardly from the boat plane 142 while the second generally triangular-shaped structure 222 is directed inwardly, that is, toward the boat plane. The first and second generally triangular-shaped structures are thus facing in opposite directions which provides rigidity and strength to the apparatus.

Finally, the third and sixth cylinders 156 and 204 are connected between the second boat mounting member 140 and the first motor mounting member 144 and are generally parallel and spaced apart. The third and sixth cylinders act as a third pair of fluid actuated cylinders.

FIG. 2

Referring back to FIG. 2, a first control system for controlling the first, third and fourth and sixth cylinders includes the previously described control system 70 with the addition of a first flow divider 226 for controlling hydraulic fluid flow to the first and fourth cylinders 152 and 200 and a second flow divider 228 for controlling hydraulic fluid flow to the third and sixth cylinders 156 and 204. In this embodiment, the bi-directional pump 72 and the solenoid valves 74 and 76 may be actuated to extend or retract the first and fourth cylinders 152 and 200 in unison and to extend the third and sixth cylinders 156 and 204 in unison.

FIG. 3

Referring back to FIG. 3, a second control system for controlling the second and fifth cylinders includes the second control system 78 with the addition of a third flow divider 230 and hydraulic connections between the fifth cylinder and the bi-directional pump 80. Actuation of the bi-directional pump 80 acts to extend or retract the second and fifth cylinders 154 and 204 in unison.

OPERATION—SECOND EMBODIMENT

As described in connection with the first embodiment 30, the apparatus according to the second embodiment 100 may be used to set the angular orientation of the motor plane 150 relative to the boat plane 142 by suitable extension or retraction of the second pair of cylinders 222 (second and fifth cylinders 154 and 202) while maintaining the remaining cylinders (the first, third, fourth and sixth cylinders 152, 156, 200 and 204) at constant extension.

Similarly, the motor may be moved along horizontal or vertical axes such as shown at 90 and 92 in FIG. 1. The motor may be moved along the horizontal axis 90 by simultaneous extension of the first and second pairs of cylinders 218 and 222 (first, second, fourth and fifth cylinders 152, 154, 200 and 202) with extension of the third pair (the third and sixth cylinders 156 and 204) proportionally. The motor may be lifted vertically by primary extension of the third pair of cylinders (third and sixth cylinders 156 and 204) with proportional extension of the first and second pairs 218 and 222 (the first, second, fourth and fifth cylinders 152, 154, 200 and 202).

Finally, the apparatus according to the second embodiment 100 may be used as a parallelogram apparatus wherein the first and second pairs 218 and 222 (the first, second, fourth and fifth cylinders 152, 154, 200 and 202) are maintained at constant extension and the third pair (third and sixth cylinders 156 and 204) is extended to move the motor plane 150 in an arc about the boat plane 142 while maintaining constant the angular orientation of the motor plane 150.

Figure 6:
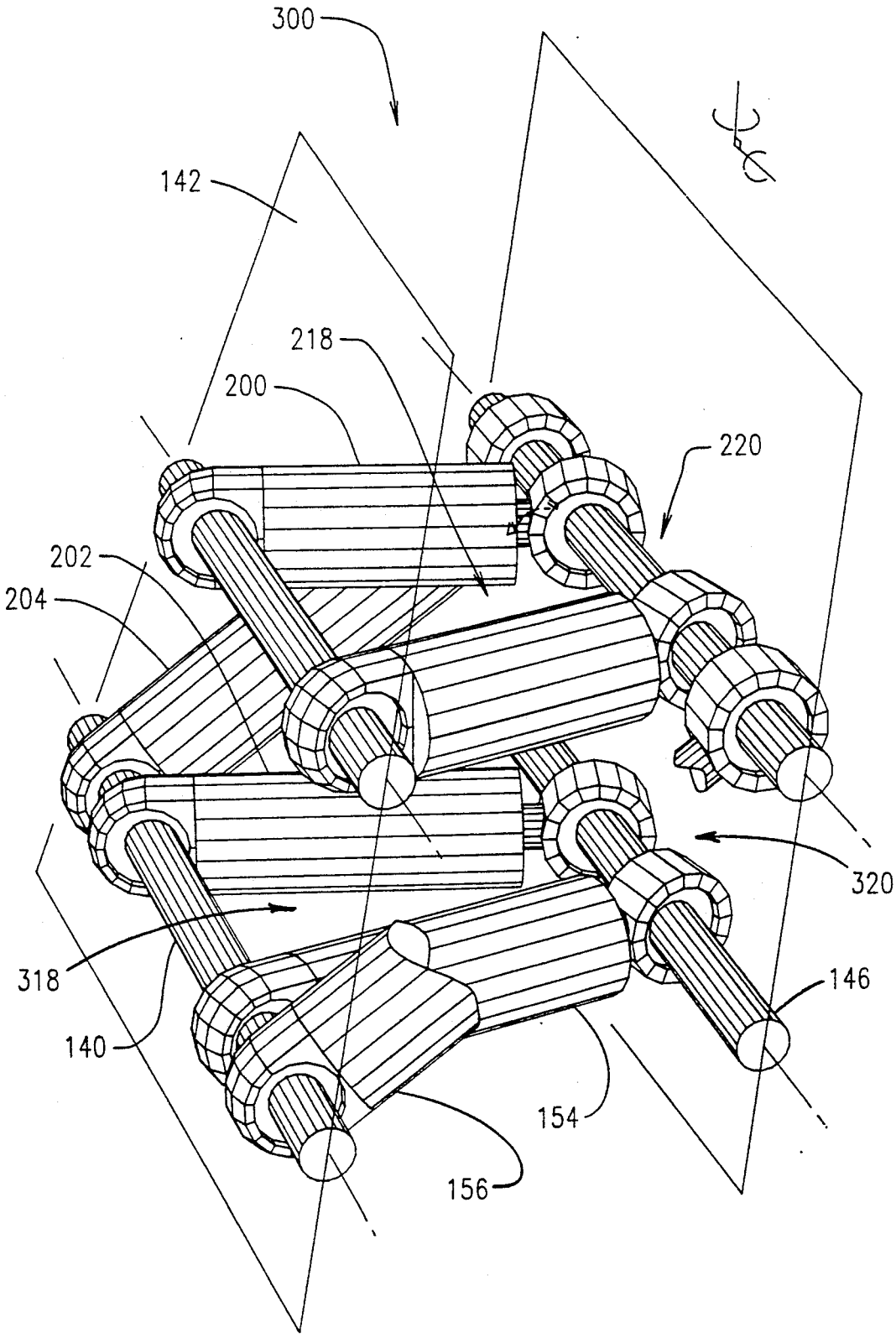
FIG. 6 is a perspective view of a motor mounting apparatus according to a third embodiment of the invention.

Third Embodiment—FIG. 6

Referring to FIG. 6, a third embodiment of the invention is shown generally at 300.

The third embodiment is basically similar to the second embodiment with the exception that second pair 218 (the second and fifth cylinders 154 and 202) are connected to the second boat mounting member 140 and the second motor mounting member 146 to form a third generally triangular shaped structure illustrated generally at 318. The third triangular structure has a third truncated apex illustrated generally at 320. In this embodiment, the first and third generally triangular shaped structures are thus facing in the same direction, that is, they are directed away or outwardly from the boat plane 142.

Figure 7:
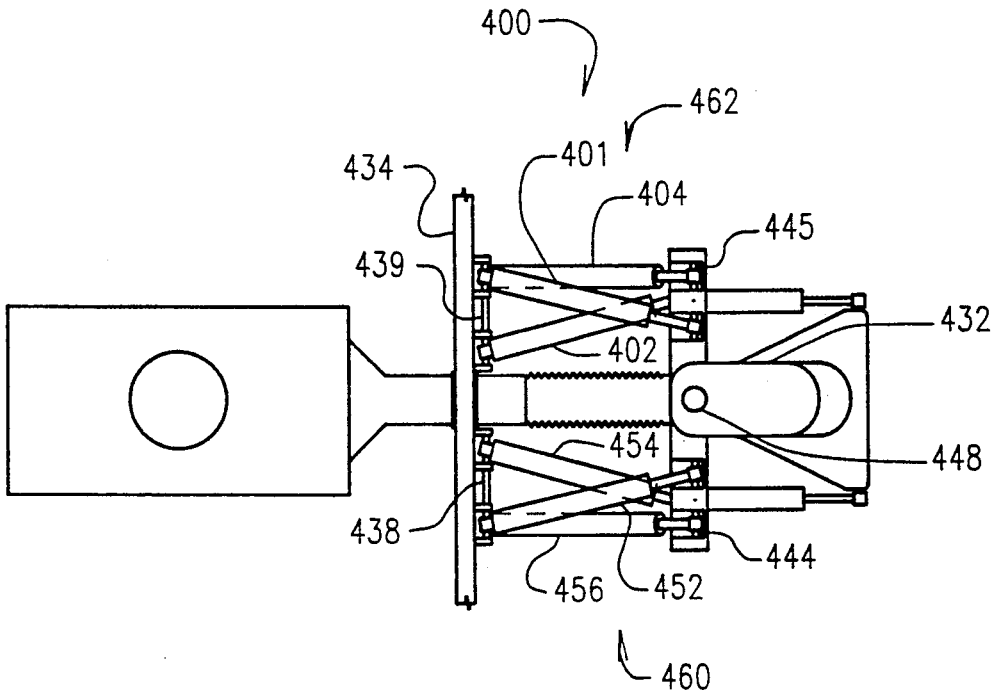
FIG. 7 is a top view of a motor mounting apparatus according to a fourth embodiment of the invention specifically adapted for use with a stern-drive.
Figure 8:
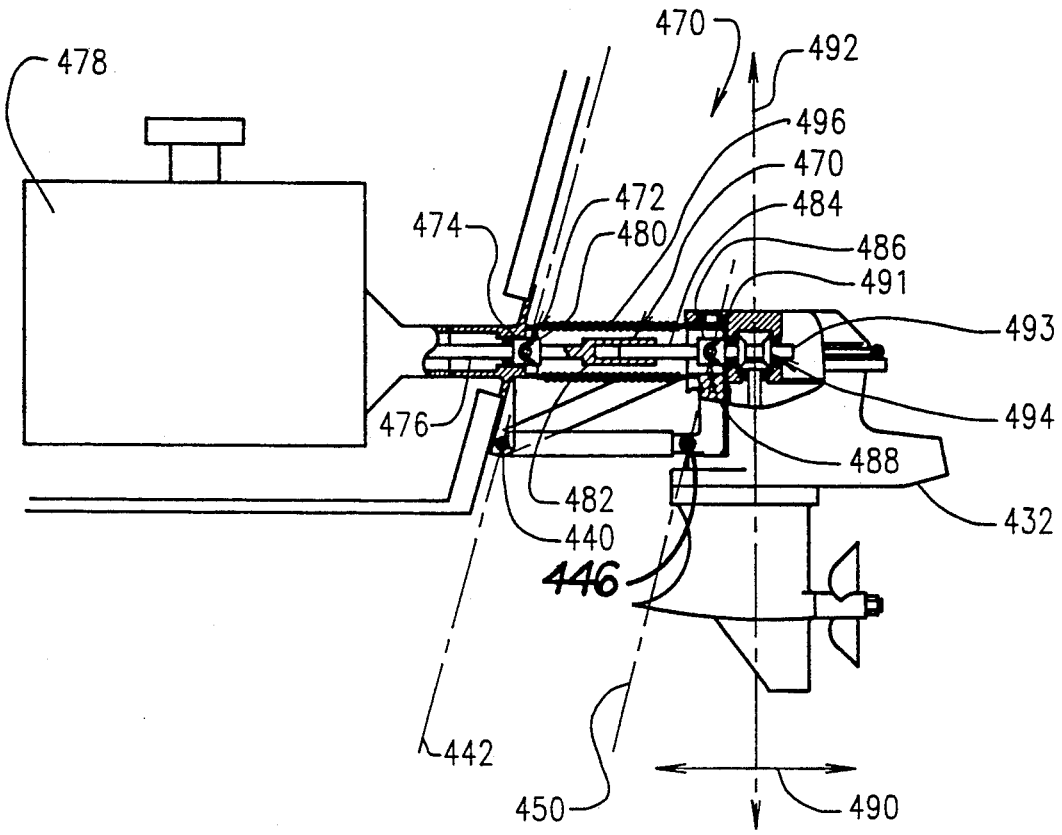
FIG. 8 is a side cross-sectional view of the motor mounting apparatus of FIG. 7.
Figure 9:
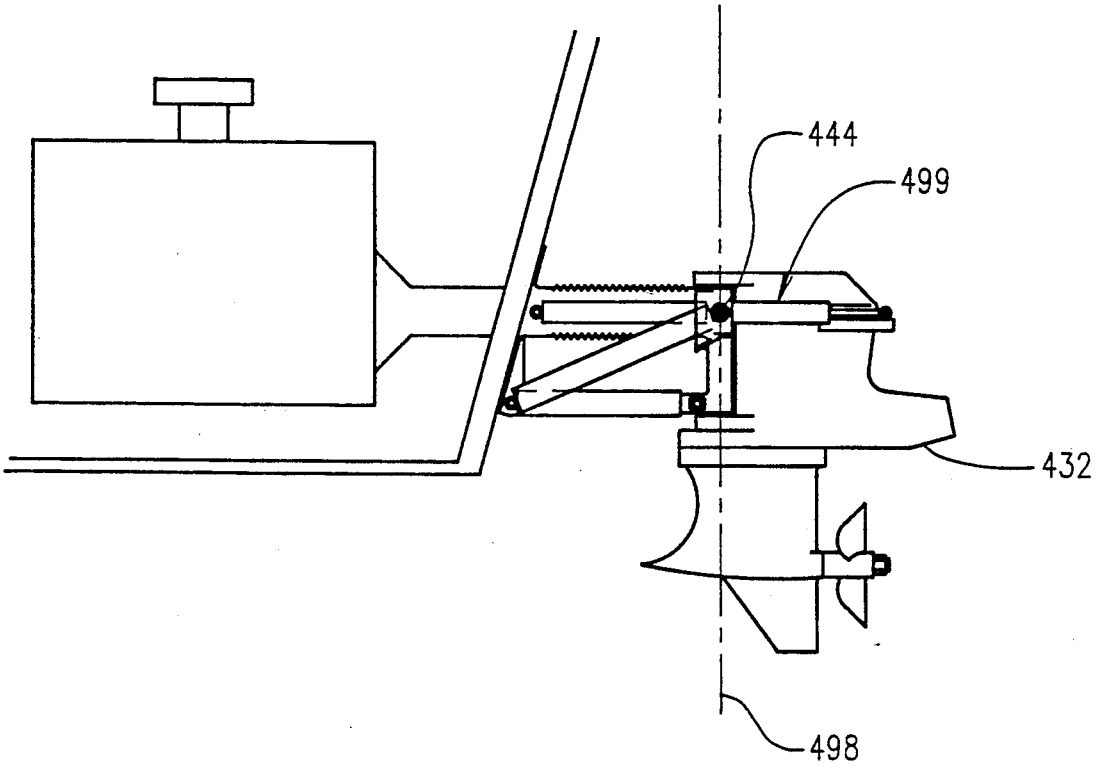
FIG. 9 is a side view of the motor mounting apparatus of FIG. 7.

Fourth Embodiment—FIGS. 7, 8 and 9

Referring to FIG. 7, an apparatus according to a fourth embodiment of the invention is shown generally at 400. The apparatus is used to mount a stern drive unit shown generally at 432 to a transom shown generally at 434. The apparatus includes cylinders disposed in an arrangement similar to that shown in FIG. 5, that is, with first and second truncated triangular structures facing in opposite directions. Referring back to FIG. 7, the apparatus includes first, second, third, fourth, fifth and sixth cylinders designated 452, 454, 456, 401, 402 and 404 respectively. Cylinders 452, 454 and 456 are disposed on a port side 460 of the boat, while the fourth, fifth and sixth cylinders are disposed on a starboard side 462 of the boat.

The apparatus includes first and second port boat mounting members 438 and 440, boat mounting member 438 being shown in FIG. 7 and member 440 being shown in FIG. 8. The first and second port boat mounting members are rigidly connected in parallel spaced apart relation to the transom 434 of the boat. In this embodiment, the first and second port boat mounting members are elongated cylindrical rods. The first and second port boat mounting members lie in a boat plane 442 which extends parallel to the transom 434 of the boat.

The apparatus further includes first and second port motor mounting members 444 and 446, member 444 being shown in FIG. 7 and member 446 being shown in FIG. 8. The port motor mounting members are rigidly connected in parallel spaced apart relation to the stern drive unit 432. In this embodiment, the first and second port motor mounting members 444 and 446 are elongated cylindrical rods secured by bolts (not shown) to a conventional steering yoke 448 of the stern drive unit. The first and second motor mounting members lie in a motor plane 450. In the embodiment shown, the motor plane is at an obtuse angle relative to the surface water as is the boat plane 442. In the embodiment shown, the motor plane and boat plane are parallel and spaced apart from each other.

Similarly, the starboard side 462 of the boat has first and second starboard boat mounting members which are rigidly connected in parallel spaced apart relation to the transom 434 of the boat. Only the first starboard boat mounting member 439 is shown in FIG. 7. Also, the apparatus includes first and second starboard motor mounting members rigidly connected in parallel spaced apart relation to the stern drive unit 432, only the first starboard motor mounting member 445 being shown in FIG. 7. The first starboard boat mounting member and the first port boat mounting member have aligned axes while the first starboard motor mounting member and the first port boat mounting member have aligned axes.

The cylinders 452, 454, 456, 401, 402 and 404 are connected between respective boat and motor mounting members using spherical rod ends as described in the embodiment of FIG. 5.

A control system for controlling the hydraulic cylinders 452, 454, 456, 401, 402 and 404 is similar to the control system explained with regard to FIGS. 2 and 3.

Referring to FIG. 8, power is supplied to the stern drive unit by a spline mechanism shown generally at 470. The spline mechanism includes a universal joint 472 having a first portion 474 connected to a conventional drive shaft 476 of an engine 478. A second portion 480 of the universal joint 472 is connected to a female spline 482. The female spline is operable to receive a male spline 484 to which is connected a first portion 486 of a second universal joint 488. A second portion 491 of the second universal joint 488 is connected by a shaft 493 to conventional gearing arrangement 494 of the stern drive unit 432. The mechanism 470 is housed within an extensible bellows 496 for protecting the splines, shafts and universal joints from moisture and dirt etc. Preferably, the first universal joint 472 is centred on the aligned axis of the first port and starboard boat mounting members. In addition, preferably the second universal joint 488 is centred on the aligned axes of the first port and starboard motor mounting members.

By using the control system explained previously with respect to FIGS. 1 through 5, the stern drive unit 432 may be moved independently or simultaneously along axes 490 and 492 shown in FIG. 8. In addition, the stern drive unit may be tilted such that the motor plane 450 is at an angular orientation relative to the boat plane 442. The stern drive unit may be angled into a downward angle of attack wherein the motor plane 450 intersects the boat plane 442 above the surface of the water or the stern drive unit may be placed into an upward attack angle wherein the motor plane 450 intersects the boat plane 442 below the surface of the water.

Referring to FIG. 9, it will be appreciated that conventional steering of the stern drive unit 432 is accomplished by rotation of the stern drive unit 432 about its conventional steering axis 498 which intersects the axis of the first port and starboard motor mounting members, only the port motor mounting member 444 being shown in FIG. 9. It will be appreciated that the second universal joint 488 accommodates steering action of the stern drive unit while also accommodating tilting and vertical and horizontal movement of the stern drive unit. Forces required to move the stern drive unit for steering are provided by conventional steering cylinders indicated generally at 499.

Alternatively, and with a more complex hydraulic control system (not shown), the cylinders 452, 454, 456, 401, 402 and 404 may be used to provide the steering function. Preferably, however a conventional steering mechanism as shown is used.

Figure 10:
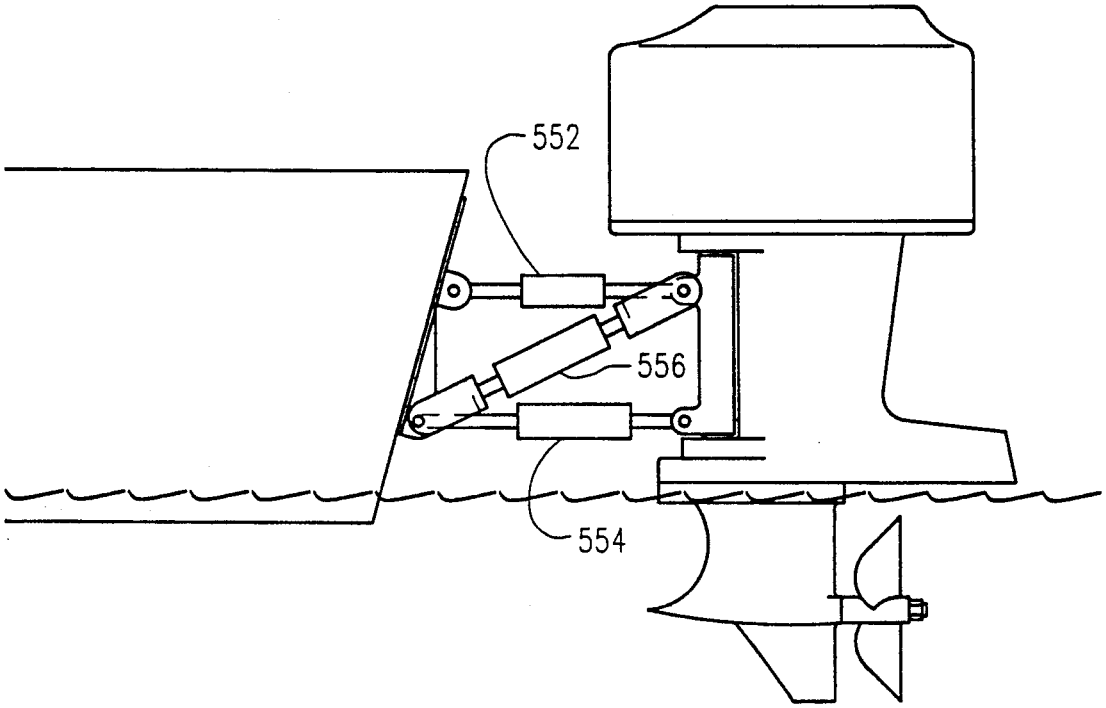
FIG. 10 is a side view of a motor mounting apparatus according to a fifth embodiment of the invention.
Figure 11:
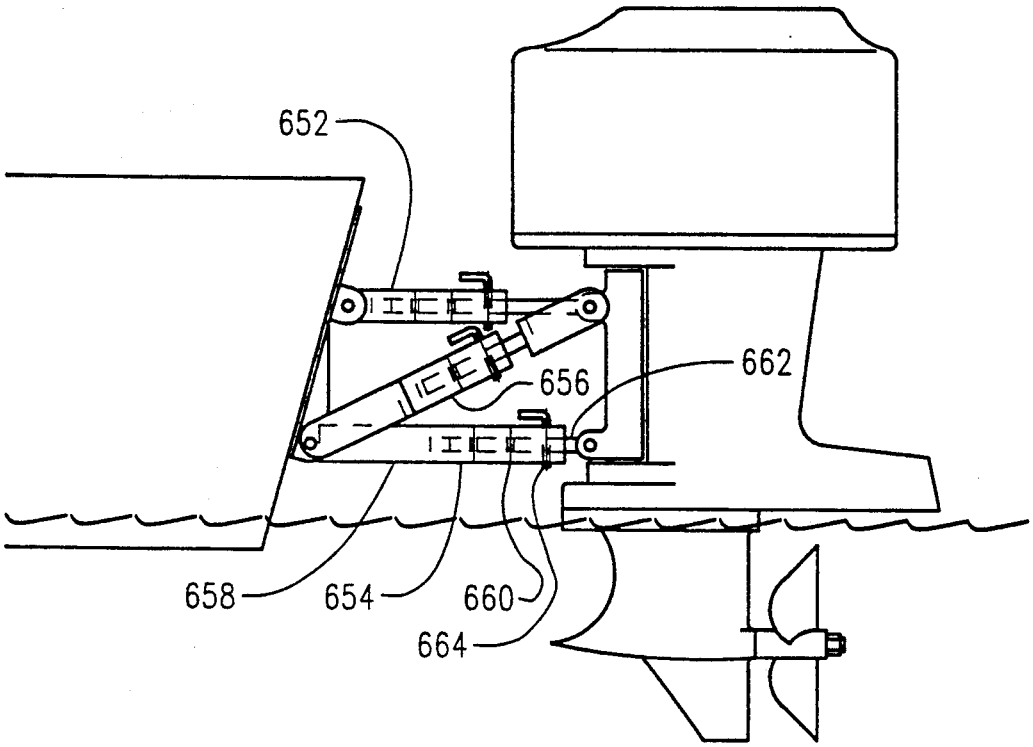
FIG. 11 is a side view of a motor mounting apparatus according to a sixth embodiment of the invention; and, FIG. 12 is a perspective view of an alternative connection for connecting a cylinder according to the first, second and third embodiments to boat and motor mounting members.
Figure 12:
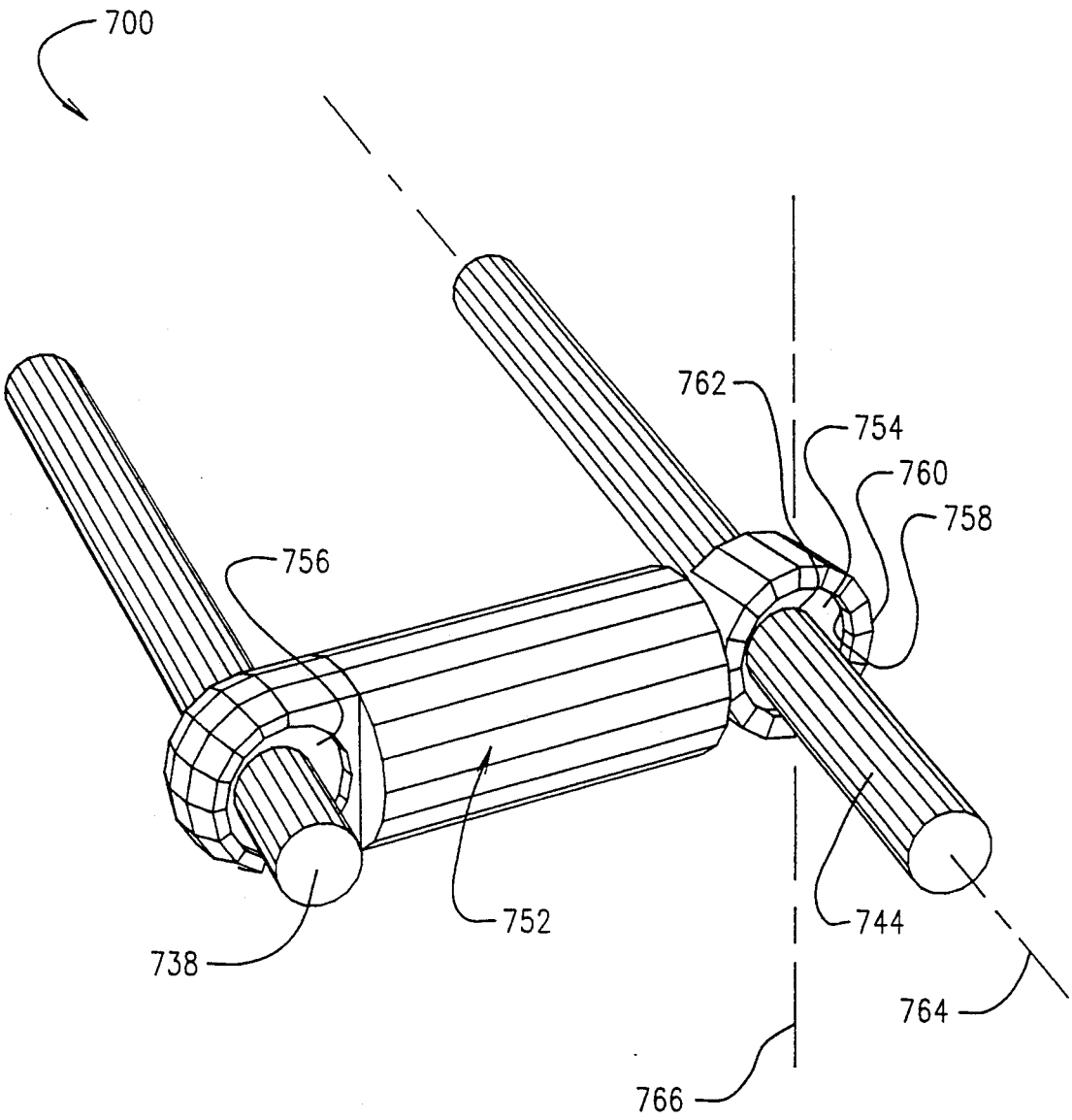

Variations—FIGS. 10, 11 and 12

While the apparatus according to the above embodiments employ hydraulic cylinders for the first, second and third members, it will be appreciated that a rigid mounting structure for mounting a motor to a transom of a boat may be implemented by making the first, second and third members of fixed length. Similarly, the first, second, third, fourth, fifth and sixth members may all be made of fixed length to provide a rigid motor mounting structure.

FIG. 10

Referring to FIG. 10, in an alternative embodiment, the first, second and third hydraulic cylinders are replaced with first, second and third turnbuckles 552, 554 and 556 which also render the first, second and third cylinders extensible and retractable. Also alternatively, (but not shown) the first, second, third, fourth, fifth and sixth members of the second embodiment may include first, second, third, fourth, fifth and sixth turnbuckles.

FIG. 11

Referring to FIG. 11, in a further alternative embodiment, the first, second and third hydraulic cylinders are replaced with first, second and third pinned cylinders 652, 654 and 656. Each pinned cylinder includes a cylindrical member 658 having a plurality of openings 660 diametrically disposed therethrough. A cylindrical rod 662 is received within the cylinder 658, the rod having corresponding transversely extending openings corresponding to the openings 660 in the cylinder 658. To set the extension of the device, the rod 662 is extracted or inserted manually into the cylinder 658 until the desired extension is reached. A pin 664 is inserted into the nearest transverse opening in the rod 662 which lines up with the nearest opening 660 in the cylinder to lock the rod against further extension or retraction relative to the cylinder 658.

FIG. 12

Referring to FIG. 12 an alternative to the hydraulic cylinders employing the spherical rod ends is shown generally at 700. In this embodiment, only a single hydraulic cylinder is shown generally at 752, it being understood that the cylinder depicted is representative of all six cylinders used in the embodiment according to FIGS. 5 through 9. In this embodiment therefore, the spherical rod ends are replaced with elastomeric bushings designated 754 and 756 respectively. The elastomeric bushings are secured by an adhesive applied, as indicated at 758, to an end portion 760 of the cylinder 752. The elastomeric bushing is thus rigidly secured to the end portion of the cylinder. Similarly, a further application of adhesive 762 is applied between the bushing and the first motor mounting member 744 and therefore the elastomeric bushing is also secured to the motor mounting member. Elastomeric bushing 756 is similarly secured using similar applications of adhesive to the second end portion of the cylinder and the first boat mounting member 738 respectively.

The elastomeric bushing permits flexure between the end portion 760 and the motor mounting member 744 while providing a rigid connection of the end portion to the motor mounting member. The bushing permits a degree of rotational movement between the end portion 760 and the motor mounting member 744 about the axes of the motor mounting member 764 and permits a degree of rotational movement about an axis 766 perpendicular to the axis 764 due to the flexible nature of the bushing. It will be appreciated that the range of movement required in each of these directions is relatively small and therefore only limited flexing of the elastomeric bushing is required. The elastomeric bushing is therefore an alternative to the spherical rod end previously described when used in this application. Furthermore, the elastomeric bushing provides a degree of shock absorption and provides some insulation to the conduction of vibration from the motor to the boat.

While specific embodiments of the invention have been described and illustrated, such embodiments are not considered to be limiting the invention as construed in accordance with the accompanying claims.

What is claimed is:

1. An apparatus for mounting a motor drive unit to a boat, the apparatus comprising:

a) first and second boat mounting members securable to a boat and lying in a boat plane;

b) first and second motor members securable to a motor and lying in a motor plane spaced apart from said boat plane by a distance, the motor plane having an angular orientation relative to said boat plane;

c) setting means connected between said boat mounting members and said motor mounting members for setting said motor mounting members in a position displaced from said boat mounting members, said setting means permitting movement of said motor mounting members relative to said boat mounting members, to selectively and independently set said angular orientation, to selectively and independently set the distance between the boat plane and the motor plane, and to selectively and independently set the vertical translation of the motor plane relative to the boat plane.

2. An apparatus as claimed in claim 1 wherein said setting means includes:

a) first, second and third extensible and retractable members; and b) first, second and third pivotal connecting means respectively, said first connecting means for pivotally connecting the first extensible and retractable member between said first boat member and said first motor member, said second connecting means for pivotally connecting the second extensible and retractable member between said second boat member and said second motor member and said third connecting means for pivotally connecting the third extensible and retractable member between said second boat member and said first motor member respectively.

3. An apparatus as claimed in claim 2 wherein the first, second and third extensible and retractable members include first, second and third fluid actuated cylinders respectively.

4. An apparatus as claimed in claim 2 wherein said first, second and third extensible and retractable members include first, second and third turnbuckles respectively.

5. An apparatus as claimed in claim 2 wherein:

a) said setting means further includes fourth, fifth and sixth extensible and retractable members; and b) fourth, fifth and sixth pivotal connecting means respectively, the fourth connecting means for pivotally connecting the fourth extensible and retractable member between said first boat member and said first motor member, the fifth connecting means for pivotally connecting the fifth extensible and retractable member between said second boat member and said second motor member and the sixth connecting means for pivotally connecting the sixth extensible and retractable member between said second boat member and said first motor member respectively.

6. An apparatus as claimed in claim 5 wherein:

a) the first and fourth extensible and retractable members are connected to the first boat mounting member and to the first motor mounting member to form a first generally triangular-shaped structure;

b) the second and fifth extensible and retractable members are connected to the second boat mounting member and to the second motor mounting member to form a second generally triangular-shaped structure, the second generally triangular-shaped structure being disposed in an opposite direction to the first generally triangular-shaped structure; and c) the third and sixth extensible and retractable members are connected to the second boat mounting member and to the first motor mounting member such that the third and sixth members are generally parallel and spaced apart.

7. An apparatus as claimed in claim 5 wherein said first, second, third, fourth, fifth and sixth extensible and retractable members include first, second, third, fourth, fifth and sixth fluid actuated cylinders respectively.

8. An apparatus as claimed in claim 5 wherein said first, second, third, fourth, fifth, and sixth extensible and retractable members include first, second, third, fourth, fifth and sixth turnbuckles respectively.

9. An apparatus as claimed in claim 5 wherein the respective pivotal connecting means include spherical rod ends on each end portion of each extensible and retractable member, the spherical rod ends being connected to respective first and second boat mounting members and respective motor mounting members.

10. An apparatus as claimed in claim 5 wherein the respective pivotal connecting means include flexible elastomer bushings on each end portion of each extensible and retractable member, the flexible elastomer bushings being connected to respective first and second boat mounting members and respective motor mounting members.

11. An apparatus as claimed in claim 1 wherein said setting means includes moving means for moving said motor mounting members into said position.

12. An apparatus as claimed in claim 11 wherein said moving means includes:

a) first, second and third extensible and retractable members; and b) first, second and third pivotal connecting means respectively, said first connecting means for pivotally connecting the first extensible and retractable member between said first boat member and said first motor member, said second connecting means for pivotally connecting the second extensible and retractable member between said second boat member and said second motor member and said third connecting means for pivotally connecting the third extensible and retractable member between said second boat member and said first motor member respectively; and c) first extending and retracting means for extending and retracting said first, second and third extensible and retractable members.

13. An apparatus as claimed in claim 12 wherein said first, second and third extensible and retractable members include first, second and third fluid actuated cylinders respectively.

14. An apparatus as claimed in claim 13 wherein said first extending and retracting means includes a first hydraulic system for actuating said fluid actuated cylinders.

15. An apparatus as claimed in claim 12 wherein said first extending and contracting means includes first control means for controlling extension and retraction of said first, second and third extensible and retractable members such that each of said members can be actuated independently.

16. An apparatus as claimed in claim 12 wherein said moving means includes angular orientation setting means for setting the angular orientation of said motor plane relative to said boat plane without changing the distance between the motor plane and the boat plane and without changing the vertical translation of said motor plane relative to said boat plane.

17. An apparatus as claimed in claim 16 wherein said first, second and third extensible and retractable members include first, second and third fluid actuated cylinders respectively and wherein said angular orientation setting means includes a fluid control system for controlling fluid flow to said first, second and third fluid actuated cylinders.

18. An apparatus as claimed in claim 12 wherein said moving means includes horizontal location setting means for setting the horizontal location of said motor plane relative to said boat plane without changing the angular orientation of said motor plane relative to said boat plane and without changing the vertical translation of said motor plane relative to said boat plane.

19. An apparatus as claimed in claim 18 wherein said first, second and third members include first, second and third fluid actuated cylinders respectively and wherein said horizontal position setting means includes a fluid control system for controlling fluid flow to said first, second and third fluid actuated cylinders.

20. An apparatus as claimed in claim 12 wherein said moving means includes vertical translation setting means for setting the vertical translation of said motor plane relative to said boat plane without changing the distance between the motor plane and the boat plane and without changing the angular orientation of said motor plane relative to said boat plane.

21. An apparatus as claimed in claim 20 wherein said first, second and third members include first, second and third fluid actuated cylinders respectively and wherein said vertical translation setting means includes a fluid control system for controlling fluid flow to said first, second and third fluid actuated cylinders.

22. An apparatus as claimed in claim 12 wherein said setting means further includes:

a) fourth, fifth and sixth extensible and retractable members; and b) fourth, fifth and sixth pivotal connecting means respectively, the fourth connecting means for pivotally connecting the fourth extensible and retractable member between said first boat member and said first motor member, the fifth connecting means for pivotally connecting the fifth extensible and retractable member between said second boat member and said second motor member and the sixth connecting means for pivotally connecting the sixth extensible and retractable member between said second boat member and said first motor member respectively; and c) second extending and retracting means for extending and retracting said fourth, fifth and sixth fluid actuated cylinders respectively.

23. An apparatus as claimed in claim 22 wherein:

a) the first and fourth extensible and retractable members are connected to the first boat mounting member and to the first motor mounting member to form a first generally triangular-shaped structure;

b) the second and fifth extensible and retractable members are connected to the second boat mounting member and to the second motor mounting member to form a second generally triangular-shaped structure, the second generally triangular-shaped structure being disposed in an opposite direction to the first generally triangular-shaped structure; and c) the third and sixth extensible and retractable members are connected to the second boat mounting member and to the first motor mounting member such that the third and sixth members are generally parallel and spaced apart.

24. An apparatus as claimed in claim 22 wherein the respective pivoting means includes spherical rod ends on each end portion of each extensible and retractable member, the spherical rod ends being connected to respective first and second boat mounting members and respective motor mounting members.

25. An apparatus as claimed in claim 22 wherein the respective pivoting means includes flexible elastomer bushings on each end portion of each extensible and retractable member, the flexible elastomer bushings being connected to respective first and second boat mounting members and respective motor mounting members.

26. An apparatus as claimed in claim 22 wherein said first, second, third, fourth, fifth, and sixth extensible and retractable members include first, second, third, fourth, fifth and sixth fluid actuated cylinders respectively.

27. An apparatus as claimed in claim 22 wherein said moving means includes first control means for controlling extension and retraction of said first, second, third, fourth, fifth and sixth extensible and retractable members such that said first and fourth members can be actuated in unison and independently of the remaining members, and such that said second and fifth members can be actuated in unison and independently of the remaining members, and such that the third and sixth members can be actuated in unison and independently of the remaining members.

28. An apparatus as claimed in claim 22 wherein said moving means includes angular orientation setting means for setting the angular orientation of said motor plane relative to said boat plane without changing the distance between the motor plane and the boat plane and without changing the vertical translation of said motor plane relative to said boat plane.

29. An apparatus as claimed in claim 28 wherein said first, second, third, fourth, fifth, and sixth extensible and retractable members include first, second, third, fourth, fifth and sixth fluid actuated cylinders respectively and wherein said angular orientation setting means includes a fluid control system for controlling fluid flow to each of said fluid actuated cylinders.

30. An apparatus as claimed in claim 22 wherein said moving means includes horizontal location setting means for setting the horizontal location of said motor plane relative to said boat plane without changing the angular orientation of said motor plane relative to said boat plane and without changing the vertical translation of said motor plane relative to said boat plane.

31. An apparatus as claimed in claim 30 wherein said first, second, third, fourth, fifth and sixth extensible and retractable members include first, second, third, fourth, fifth and sixth fluid actuated cylinders respectively and wherein said horizontal position setting means includes a fluid control system for controlling fluid flow to each of said fluid actuated cylinders.

32. An apparatus as claimed in claim 22 wherein said moving means includes vertical translation setting means for setting the vertical translation of said motor plane relative to said boat plane without changing the distance between the motor plane and the boat plane and without changing the angular orientation of said motor plane relative to said boat plane.

33. An apparatus as claimed in claim 32 wherein said first, second, third, fourth, fifth and sixth extendible and retractable members include first, second, third, fourth, fifth and sixth fluid actuated cylinders respectively and wherein said vertical translation setting means includes a fluid control system for controlling fluid flow to each of said fluid actuated cylinders.

34. In combination:

a) a boat having a transom;

b) a motor drive unit; and c) a motor drive unit mounting apparatus comprising:

i) first and second boat mounting members securable to a boat and lying in a boat plane;

ii) first and second motor mounting members securable to a motor and lying in a motor plane spaced apart from said boat plane by a distance, the motor plane having an angular orientation relative to said boat plane;

iii) setting means connected between said boat mounting members and said motor mounting members for setting said motor mounting members in a position displaced from said boat mounting members, said setting means permitting movement of said motor mounting members relative to said boat mounting members, to selectively and independently set said angular orientation, to selectively and independently set the distance between the boat plane and the motor plane, and to selectively and independently set the vertical translation of the motor plane relative to the boat plane.

35. An apparatus for mounting a motor drive unit to a boat, the apparatus comprising:

i) first and second parallel spaced apart boat mounting members securable to a transom of a boat, the first and second boat mounting members being disposed in a boat plane;

ii) first and second parallel spaced apart motor mounting members securable to a motor, the first and second motor mounting members being disposed in a motor plane, the motor plane having an angular orientation relative to the boat plane;

c) setting means connected between the first and second boat mounting members and the first and second motor mounting members, for setting the first and second motor mounting members in a position displaced from said first and second boat mounting members, said setting means including moving means for moving the first and second motor mounting members relative to the first and second boat mounting members along two mutually orthogonal axes while holding the angular orientation constant, the moving means including:

i) a first pair of fluid actuated cylinders extending between the first boat mounting member and the first motor mounting member, each of the first pair of fluid actuated cylinders having respective ends with respective spherical rod ends thereon for connecting respective ends to the first boat mounting member and first motor mounting member respectively, such that the first pair of cylinders converges inwards toward the first motor mounting member to form a first generally triangular-shaped structure;

ii) a second pair of fluid actuated cylinders extending between the second boat mounting member and the second motor mounting member, each of the second pair of fluid actuated cylinders having respective ends with respective spherical rod ends thereon for connecting respective ends to the second boat mounting member and second motor mounting member respectively such that the second pair of fluid actuated cylinders diverges outwards from the second boat mounting member to form a second generally triangular-shaped structure, the second generally triangular-shaped structure being disposed in an opposite direction to the first generally triangular-shaped structure;

iii) a third pair of fluid actuated cylinders extending between the second boat mounting member and the first motor mounting member, each of the third pair of fluid actuated cylinders having respective ends with respective spherical rod ends thereon for connecting respective ends to the second boat mounting member and first motor mounting member, the third pair of fluid actuated cylinders being connected to the second boat mounting member and first motor mounting member such that the third pair of fluid actuated cylinders is generally parallel and spaced apart;

the first, second and third pairs of cylinders being independently actuable to selectively and independently set said angular orientation, to set the distance between the boat plane and the motor plane and to set the vertical translation of the motor plane relative to the boat plane.

* * * * *